US011238819B2

(12) United States Patent
Liu et al.

(10) Patent No.: US 11,238,819 B2
(45) Date of Patent: Feb. 1, 2022

(54) DISPLAY-DRIVING CIRCUIT, DISPLAY APPARATUS, AND DISPLAY METHOD BASED ON TIME-DIVISION DATA OUTPUT

(71) Applicants: BEIJING BOE OPTOELECTRONICS TECHNOLOGY CO., LTD., Beijing (CN); BOE Technology Group Co., Ltd., Beijing (CN)

(72) Inventors: Bingxin Liu, Beijing (CN); Jian Sun, Beijing (CN); Ziqiang Guo, Beijing (CN); Lin Lin, Beijing (CN); Yadong Ding, Beijing (CN); Binhua Sun, Beijing (CN); Jiyang Shao, Beijing (CN); Feng Zi, Beijing (CN); Yakun Wang, Beijing (CN); Ke Li, Beijing (CN)

(73) Assignees: BEIJING BOE OPTOELECTRONICS TECHNOLOGY CO., LTD., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/638,933

(22) PCT Filed: Mar. 4, 2019

(86) PCT No.: PCT/CN2019/076859
§ 371 (c)(1),
(2) Date: Feb. 13, 2020

(87) PCT Pub. No.: WO2020/177053
PCT Pub. Date: Sep. 10, 2020

(65) Prior Publication Data
US 2021/0233482 A1 Jul. 29, 2021

(51) Int. Cl.
*G09G 3/36* (2006.01)

(52) U.S. Cl.
CPC ... *G09G 3/3618* (2013.01); *G09G 2310/0286* (2013.01); *G09G 2310/0291* (2013.01)

(58) Field of Classification Search
CPC ..... G09G 3/3618; G09G 2310/0286; G09G 2310/0291; G09G 5/00; G09G 5/395;
(Continued)

(56) References Cited

U.S. PATENT DOCUMENTS 5,230,064 A * 7/1993 Kuo ..... G09G 5/395 345/505
5,799,174 A * 8/1998 Muntz ..... H04N 21/2318 345/501
(Continued)

FOREIGN PATENT DOCUMENTS

CN 1452408 A 10/2003

OTHER PUBLICATIONS

International Search Report & Written Opinion dated Nov. 27, 2019, regarding PCT/CN2019/076859.

*Primary Examiner* — Richard J Hong
(74) *Attorney, Agent, or Firm* — Intellectual Valley Law, P.C.

(57) ABSTRACT

The present application discloses display apparatus for displaying image based on time-divisional data. The display apparatus includes a data processor including at least a first shift register and a data buffer, and configured to store a first matrix of data corresponding to the frame of image data to the data buffer at time t0, to shift the first matrix of data by m columns by the first shift register to obtain a second matrix of data stored to the data buffer at time t1. The display apparatus further includes an interface connector configured to output the first matrix of data in period T0 and the second
(Continued)

matrix of data in period T1 in a same order same as the fixed sequential order respectively over the at least two time-divisional periods T0 and T1 of a unit-time through a driver circuit to a display panel for displaying one frame of image.

18 Claims, 4 Drawing Sheets

(58) Field of Classification Search
CPC ..... G09G 3/3275; G09G 3/3406; H04N 21/2318; H05K 5/0017
See application file for complete search history.

(56) References Cited

U.S. PATENT DOCUMENTS

| | | | | |
|---|---|---|---|---|
| 2002/0047555 | A1* | 4/2002 | Inukai | G09G 3/3275 315/169.3 |
| 2005/0104825 | A1* | 5/2005 | Chao | G09G 3/3406 345/87 |
| 2007/0252797 | A1 | 11/2007 | Huang et al. | |
| 2013/0215095 | A1 | 8/2013 | Shin et al. | |
| 2015/0186098 | A1* | 7/2015 | Hall | H05K 5/0017 345/1.3 |
| 2015/0310798 | A1 | 10/2015 | Heide et al. | |
| 2018/0293949 | A1* | 10/2018 | Nakamura | G09G 5/00 |
| 2019/0064530 | A1 | 2/2019 | Lee et al. | |

* cited by examiner

DISPLAY-DRIVING CIRCUIT, DISPLAY APPARATUS, AND DISPLAY METHOD BASED ON TIME-DIVISION DATA OUTPUT

CROSS-REFERENCE TO RELATED APPLICATION

This application is a national stage application under 35 U.S.C. § 371 of International Application No. PCT/CN2019/076859, filed Mar. 4, 2019, the contents of which are incorporated by reference in the entirety.

TECHNICAL FIELD

The present invention relates to display technology, more particularly, to a display-driving circuit, a display apparatus, and a display method.

BACKGROUND

A trend for flat panel display apparatus is to continuously pursue for better image quality on screen, higher resolution, special displaying effect. Higher resolution means more image pixels on screen which is usually harder to manufacture with higher cost. Practically for lowering the cost, some high-resolution image content resources are applied to display apparatus with lower-resolution, causing issues like fussy display images. Higher resolution or high PPI panel also leads to non-compatibility or resource waste issues for not matching the display panel with available data bandwidth properly. Further, display apparatus with higher resolution also consumes higher power. For typical flat panel display apparatus based on either liquid crystal display (LCD) or organic light-emitting diode display (OLED), the display panel contains many physical gaps between screen pixels due to signal or power line layout or introduction of black matrix between subpixel circuits. These physical gaps between screen pixels may badly affect the quality of the displayed image.

SUMMARY

In an aspect, the present disclosure provides a display-driving circuit based on time-divisional data output. The display-driving circuit includes a data processor including at least a first shift register and a data buffer. The data processor is configured to receive a first frame of image data based on display refreshing rate and store a first matrix of data corresponding to the first frame of image data to the data buffer at time t0. The data processor is further configured to cause a m-column shift to the first matrix of data by the first shift register to obtain a second matrix of data stored to the data buffer at time t1. Here, t1 is different from t0 with a fixed sequential timing order of either t0 is earlier than t1 or vice versa. The display-driving circuit further includes an interface connector configured to control outputting of the first matrix of data and the second matrix of data based on timing signals provided in an order same as the fixed sequential timing order respectively over at least two time-divisional periods T0 and T1 of a unit-time for displaying one frame of image. Additionally, the display-driving circuit includes a driver circuit coupled to the interface connector to apply a respective column of a respective one of the first matrix of data and the second matrix of data to a respective one of multiple data lines.

Optionally, a sum of the at least two time-divisional periods T0 and T1 is smaller than or equal to the unit-time for displaying one frame of image which is inverse of the display refreshing rate.

Optionally, the interface connector is configured to halt outputting in a gap time T between each two sequential timing signals. A sum of the at least two time-divisional periods T0 and T1, and at least the gap time T between the at least two time-divisional periods T0 and T1 is no greater than the unit-time for displaying one frame of image.

Optionally, the in-column shift corresponds to that a k-th column of data in the second matrix of data is set to equal to (k−m)-th column of data in the first matrix of data and each of first m numbers of columns of data of the second matrix of data is repeated as a first column of data of the first matrix of data. Here m is an integer smaller than 10.

Optionally, the data processor further includes a second shift register configured to receive the first frame of image data and cause a −n-column shift to the first matrix of data to obtain a third matrix of data stored to the data buffer at time t2. Here t2 is different from t0 or t1 and t0, t1, and t2 are in a fixed sequential timing order.

Optionally, −n-column shift corresponds to that a k-th column of data in the third matrix of data is set to equal to (k+n)-th column of data in the first matrix of data and each of last n numbers of columns of data of the third matrix of data is repeated as a last column of data in the first matrix of data. Here n is an integer smaller than 10.

Optionally, the interface connector is configured to control outputting of the first matrix of data, the second matrix of data, and the third matrix of data based on timing signals provided in an order same as the fixed sequential timing order associated with t0, t1, and t2 respectively over at least three time-divisional periods T0, T1, and T2 of a unit-time for displaying one frame of image.

Optionally, the interface connector is configured to halt outputting in a gap time T between any two sequential timing signals. A sum of the at least three time-divisional periods T0, T1, T2, and at least two gap times 2T between two sequential pairs of periods is no greater than the unit-time for displaying one frame of image. Either one of T0, T1, and T2 is no smaller than a response time associated with subpixels of the display panel.

In another aspect, the present disclosure provides a display apparatus including a display-driving circuit described herein and a display panel including an array of pixel circuits with a respective one column being connected to a respective one data line coupled to a driver integrated circuit to receive a first matrix of data and a second matrix of data in respective time-divisional periods T0 and T1 of a unit-time for displaying one frame of image to display a frame of image.

Optionally, the display panel includes a liquid crystal layer configured to yield a respective transmissivity for a respective one of a plurality of subpixels within a minimum liquid-crystal response time Tr based on data of a respective one subpixel from the first matrix of data in period T0 and the second matrix of data in period T1. Here the period T0 or period T1 is no smaller than Tr.

Optionally, the display panel includes a light-emitting diode layer configured to emit light at a respective one of a plurality of subpixels within a pixel-response time Tpr to yield a pixel luminance based on data of a respective one subpixel from the first matrix of data in period T0 and the second matrix of data in period T1. The pixel-response time Tpr is substantially negligible and the at least two time-divisional periods T0 and T1 are substantially free of a low bound.

In yet another aspect, the present disclosure provides a method for displaying one frame of image using time-divisional image data. The method includes receiving a first matrix of data from a system driver. The method further includes storing the first matrix of data to a data buffer at time t0. Additionally, the method includes shifting the first matrix of data by m columns in a first direction to obtain a second matrix of data stored into the data buffer at time t1. t1 is selected to be different from t0. The method further includes shifting the first matrix of data by −n columns in a second direction opposite to the first direction to obtain a third matrix of data stored into the data buffer at time t2. t2 is selected to be different from either t0 or t1. A fixed sequential timing order associated with t0, t1, and t2 is selected. Furthermore, the method includes outputting the first matrix of data in period T0, the second matrix of data in period T1, and the third matrix of data in period T2 from the data buffer to a driver circuit of a display panel in an order same as the fixed sequential timing order associated with t0, t1, and t2. The period T0, the period T1, and the period T2 are at least three time-divisional periods of one unit-time for displaying one frame of image depending on display refreshing rate. Moreover, the method includes displaying one frame of image based on display refreshing rate using the first matrix of data in the period T0, the second matrix of data in the period T1, and the third matrix of data in the period T2.

Optionally, the step of shifting the first matrix of data by m columns in a first direction includes allowing the first matrix of data to be processed by a shift register configured to assigning respective k-th column of data in the first matrix of data to (k−m)-th column of data of the second matrix of data and keeping all of last m numbers of columns of data repeated as a last column of data in the first matrix of data. m is an integer less than 10.

Optionally, the step of shifting the first matrix of data by −n columns in a second direction includes allowing the first matrix of data to be processed by a shift register configured to assigning respective k-th column of data in the first matrix of data to (k+n)-th column of data of the third matrix of data and keeping all of first n numbers of columns of data repeated as a first column of data in the first matrix of data. n is an integer less than 10.

Optionally, the step of outputting includes providing at least three sequential timing signals in a same fixed sequential timing order to respectively enable an interface connector coupled between the data buffer and the driver circuit over three time periods respectively equal to period T0, period T1, and period T2.

Optionally, either one of period T0, T1, and T2 is set to be no smaller than a pixel response time associated with the display panel.

Optionally, the step of outputting further includes halting outputting in a gap time T between any two sequential timing signals. The gap time T is determined by that a sum of the at least T0, T1, T2, and two gap times 2×T is no greater than a unit-time of displaying one frame of image depended on the display refreshing rate.

Optionally, the display panel is a liquid crystal display panel including a liquid crystal layer over a plurality of subpixels. The step of displaying includes setting a respective one of period T0, period T1, and period T2 to be no smaller than a response time of the liquid crystal layer to a respective one matrix of data applied to the plurality of subpixels.

Optionally, the display panel is a light-emitting diode display panel including a plurality of subpixels. The step of displaying includes setting a respective one of period T0, period T1, and period T2 to be substantially free of low bound as a response time for the plurality of subpixels to emit light based on a respective one matrix of data applied thereof.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

As flat panel display technologies are progress continuously, the demands on better image quality on screen, higher resolution, special displaying effect are increasing. Higher resolution means more image pixels on screen which is usually harder to manufacture. Practically, some high-resolution image content resources are applied to display apparatus with lower-resolution for cost-saving, but it likely will cause issues for the viewers to see fussy display images. For typical flat panel display apparatus based on either liquid crystal display (LCD) or organic light-emitting diode display (MED), the display panel contains many physical gaps between screen pixels due to signal or power line layout or introduction of black matrix between subpixel circuits. These physical gaps between screen pixels may badly affect the display.

Accordingly, the present disclosure provides, inter alia, a display-driving circuit configured to generate, and output time-divisional image data based on an original matrix of data and a display apparatus to display images using the time-divisional image data to enhance display resolution visually. More particularly, one frame of image is displayed by the display apparatus using different sets of image data that are outputted in a time-divisional manner, the physical gaps existed between screen pixels of the display panel can be made up to smooth out image display effect. Additionally, the present disclosure provides a display method for pre-treating a matrix of data for displaying one frame of image to obtain one or more column-shifted matrices of data which is sequentially outputted to driver circuit in several time-divisional periods of one unit-time for displaying the one frame of image. The display apparatus and display method thereof substantially obviate one or more of the problems due to limitations and disadvantages of the related art.

Figure 1:
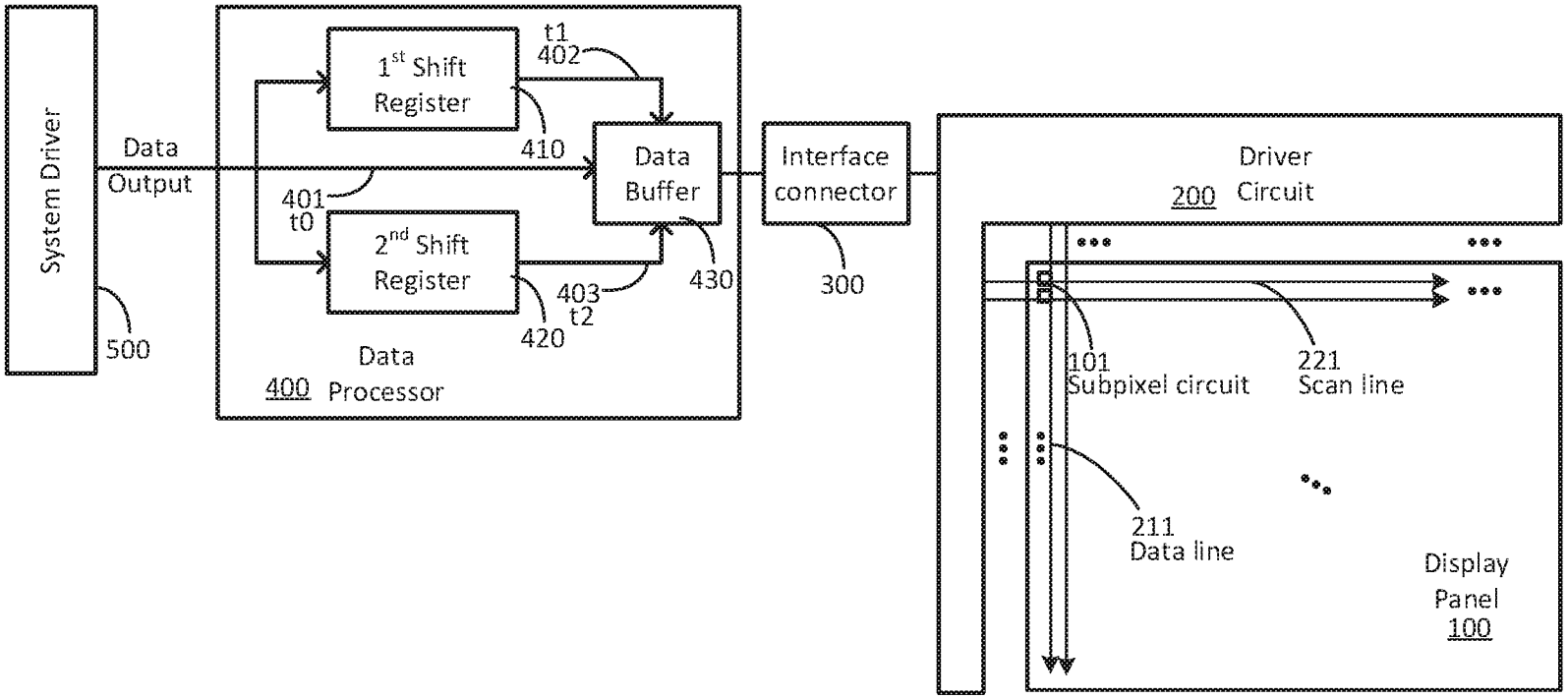
FIG. 1 is block diagram of a display-driving circuit configured to output time-divisional data for a display image on a display panel according to some embodiments of the present disclosure.

In one aspect, the present disclosure provides a display-driving circuit configured to drive a display panel for displaying image based on time-divisional data output. FIG. 1 is block diagram of a display-driving circuit configured to output time-divisional data for a display image on a display panel according to some embodiments of the present disclosure. Referring to FIG. 1, a display panel 100 includes a plurality of subpixel circuits 101 arranged in a matrix array with multiple columns and rows. Each column of subpixel circuits 101 is connected to a data line 211 coupled to a driver circuit 200. Each row of subpixel circuits 101 is connected to a scan line 221 coupled also to the driver circuit 200. Each data line 211 is configured to deliver a voltage or current signal converted from a respective one column of a matrix of data respectively to respective subpixel circuit 101 from a first row to a last row of the column based on control signals sent from respective scan lines 221 connected to the respective rows of subpixel circuits 101 sequentially from the first row to the last row.

Optionally, the driver circuit 200 is configured to receive the matrix of data. designed to allow one frame of image to be displayed in a unit-time based on a display refreshing rate of the display panel. The driver circuit 200 is configured to generate the control signals timely scanning row-by-row to activate respective rows of subpixel circuits. Depending on different types of the display panels, the activated subpixel circuit is driven by the voltage or current signal converted from a respective one column of a matrix of data to perform different display tasks. For example, for a display panel based on passive liquid-crystal display (LCD), the activated subpixel circuit is to output a voltage across two electrodes of a liquid crystal layer to apply an electrical field to cause rotation of liquid crystal molecules thereof. The rotation of the liquid crystal molecules subsequently changes optical transmissivity of the liquid crystal layer for producing proper luminance per pixel based on a fixed back plain light source. For example, for a display panel based on active organic light-emitting diode (OLED), the activated subpixel circuit is to induce a light emission directly to achieve proper luminance per pixel for displaying an image.

Referring to FIG. 1, a system driver 500 is configured to provide the matrix of data that is designed to be sent to the driver circuit 200 to drive the display panel 100 to display one frame of image on the display panel 100. Optionally, the system driver 500 is a central processing unit (CPU) configured to generate the matrix of data based on image data received from an image source (e.g., a digital cable or a video camera). Optionally, the system driver 500 is an application processor (AP). In the embodiment, the matrix of data is sent to a data processor 400 via Data. Output of the system driver 500. The data processor 400 includes at least a first shift register 410, a second shift register 420, and a data buffer 430. The first shift register 410 and the second shift register 420 have their Inputs directly coupled to the Data Output of the system driver 500. The data buffer 430 is coupled respectively to Outputs of the first shift register 410 and the second shift register 420, and is also directly coupled to the Data Output of the system driver 500.

Figure 2A:
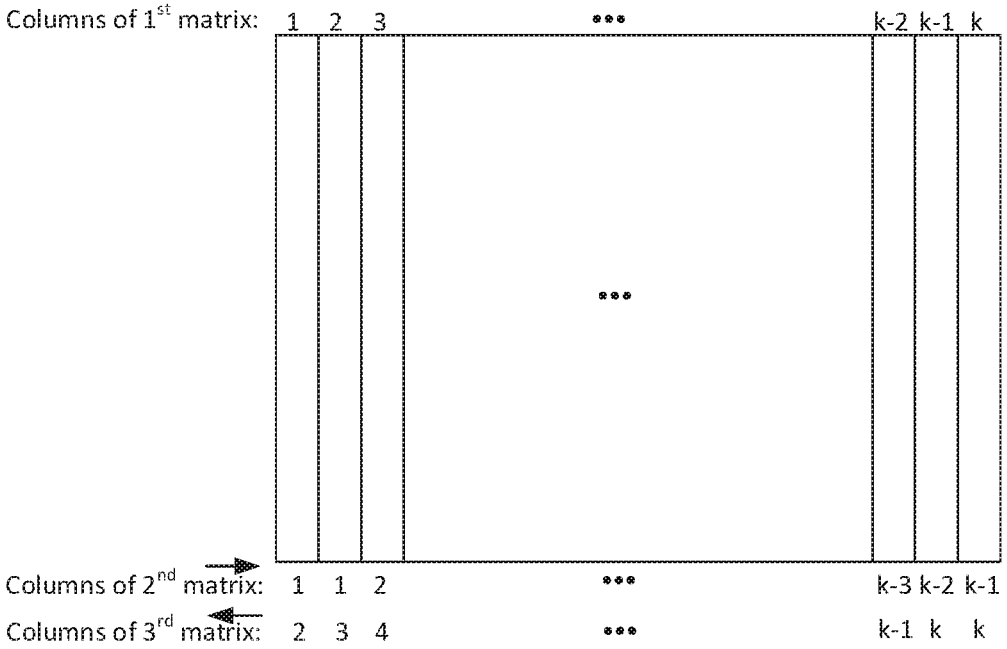
FIG. 2A is a schematic diagram illustrating two shifted matrices of data based on a first matrix of data according to an embodiment of the present disclosure.

In an embodiment, a first matrix of data 401 from the Data Output of the system driver 500 is received by the data processor 400 and is saved directly to the data buffer 430 at time t0. Optionally, the first matrix of data 401 includes multiple columns of data the same as original multiple columns of data in the matrix of data designed for displaying one frame of image at the display panel. In the embodiment, the first matrix of data 401 is also received by the first shift register 410. Each column of data in the first matrix of data 401 is processed in the first shift register 410 to generate a second matrix of data 402, and the second matrix of data 402 is saved at time t1 into the data buffer 430. Here, time t1 is different from time t0. The time t0 and t1 can be set in a sequential timing order of t0 ahead of t1 or vice versa. Optionally, each column of data in the second matrix of data 402 is same as a respective column of data in the first matrix of data 401 shifted by +m columns in a first direction. Optionally, m is an integer smaller than 10. For example, m=1, i.e., corresponding to one column shift to the right or forward, as shown in FIG. 2A. The second matrix of data 402 is substantially the first matrix of data 401 shifted by 1 column forward. In particular, the second column of the second matrix of data is shifted from the first column of the first matrix of data. The third column of the second matrix of data is shifted from the second column of the first matrix of data. Further on, the k-th column of the second matrix of data is shifted from (k−1)-th column of the first matrix of data. While the first column of the second matrix of data is repeated to be the same as the first column of the first matrix of data.

Figure 2B:
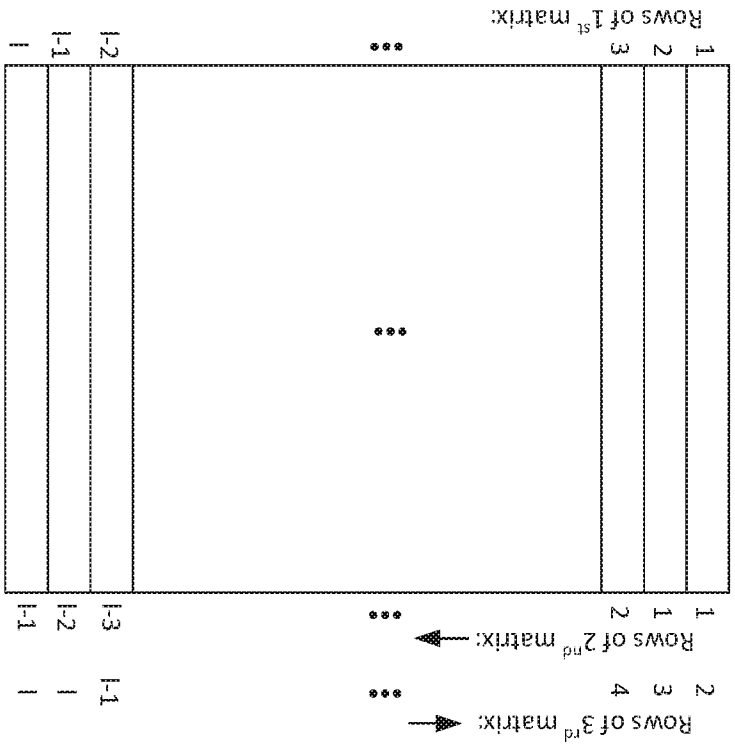
FIG. 2B is a schematic diagram illustrating two shifted matrices of data based on a first matrix of data according to another embodiment of the present disclosure.

Optionally, the second matrix of data 402 can be generated by processing the first matrix of data 401 in the data processor 400 such that each row of the second matrix of data 402 is same as a respective row of the first matrix of data 401 shifted by +i rows in a first direction. Optionally, i is an integer smaller than 10. For example, i=1 corresponding to a shift to one row down, as shown in FIG. 2B. In particular, the second row of the second matrix of data is shifted from the first row of the first matrix of data. The third row of the second matrix of data is shifted from the second row of the first matrix of data. Further on, the l-th row of the second matrix of data is shifted from (l−1)-th row of the first matrix of data. While the first row of the second matrix of data is repeated to be the same as the first row of the first matrix of data.

Additionally in the embodiment, the first matrix of data is also received by the second shift register 420. Each column of data in the first matrix of data 401 is processed in the second shift register 420 to generate a third matrix of data 403, and the third matrix of data 403 is saved at time t2 into the data buffer 430. Here, time t2 is different from time t0 and also different from time t1. The time t0, t1, and t2 can be in any sequential timing order. In a specific embodiment, the timing order of t0, t1, and t2 is a fixed sequential timing order, no matter what that order is, throughout the data output process from the system driver 500 to the data processor 400 for the display apparatus. Optionally, each column of data in the third matrix of data 403 is same as a respective column of data in the first matrix of data 401 shifted by −n columns in a second direction. Optionally, n is an integer smaller than 10. For example, n=1, i.e., corresponding to one column shift to the left or backward, as shown in FIG. 2A. The third matrix of data 403 is substantially the first matrix of data 401 shifted by 1 column backward. In particular, the first column of the third matrix of data is shifted from the second column of the first matrix of data. The second column of the third matrix of data is shifted from the third column of the first matrix of data. Further on, the second-to-the last (k−1)-th column of the third matrix of data is shifted from k-th column of the first matrix of data. While the last k-th column of the third matrix of data is repeated to be the same as the last column of the first matrix of data.

Optionally, the third matrix of data 403 can be generated by processing the first matrix of data 401 in the data processor 400 such that each row of the third matrix of data 403 is same as a respective row of the first matrix of data 401 shifted by −j rows in a second direction. Optionally, j is an integer smaller than 10. For example, j=1 corresponding to a shift to one row up, as shown in FIG. 2B. In particular, the first row of the third matrix of data is shifted from the second row of the first matrix of data. The second row of the third matrix of data is shifted from the third row of the first matrix of data. Further on, the second-to-the last (l−1)-th row of the third matrix of data is shifted from l-th row of the first matrix of data. While the last l-th row of the third matrix of data is repeated to be the same as the last row of the first matrix of data.

Referring back to FIG. 1, the display apparatus further includes an interface connector 300 coupled between the data processor 400 and the driver circuit 200. Optionally, the interface connector 300 is configured under MIPI Display Serial interface (MIPI DSI) protocol, though other types of data-communication interface architecture can be employed. Optionally, the interface connector 300 is enabled by a digital enabling signal EN to be able to transfer data under a certain communication scheme from the data buffer 430 to the driver circuit 200.

In an embodiment, the interface connector 300 is configured in a communication scheme to control outputting of the first matrix of data, the second matrix of data, the third matrix of data from the data buffer 430 based on timing signals provided in an order same as the fixed sequential timing order associated with t0, t1, t2 respectively over at least time-divisional periods T0, T1, T2 of a unit-time for displaying one frame of image.

Figure 3:
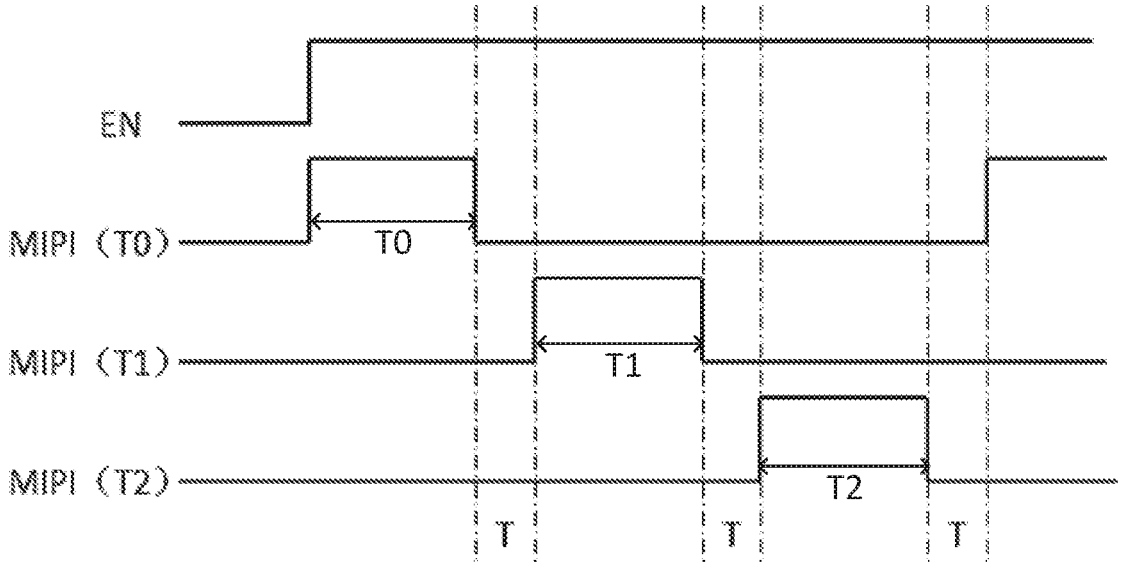
FIG. 3 is a timing diagram of signals to enable an interface connector for sending time-divisional data according to an embodiment of the present disclosure.

FIG. 3 is a timing diagram of signals to enable an interface connector for sending time-divisional data according to an embodiment of the present disclosure. For example, the unit-time of displaying one frame of image is divided to at least three time-divisional periods T0, T1, and T2. In one time-divisional period T0, a timing signal MIPI(T0) is provided as a positive voltage pulse with a pulse width of T0 to enable the interface connector 300 to open a communication channel between the data buffer 430 in the data processor 400 and the driver circuit 200.

Similarly, in another time-divisional period T1, another timing signal MIPI(T1) is provided to enable the interface connector 300. In yet another time-divisional period T2, yet another timing signal MIPI(T2) is provided to enable the interface connector 300. Either T0, T1, and T2 is different period without overlap in time. A sum of T0, T1, and T2 is no greater than one unit-time of displaying one frame of image determined by display refreshing rate. Although FIG. 3 shows an order in time as T0 at beginning followed by T1 then T2, the timing order can be also arranged in other ordering combination like T0, T2, and T1; or T1, T0, and T2; or T1, T2, and T0; or T2, T0, and T1; or T2, T1, and T0. No matter what the order of the timing signals associated with T0, T1, and T2, it is restricted to a same order as the fixed sequential order associated with t0, t1, and t2. In other words, the combination of the data buffer 430 and the interface connector 300 is synchronized to establish a first-in-first-out data output scheme. If a first matrix of data 401 is saved into the data buffer 430 first, the first matrix of data 401 is firstly outputted via the interface connector 300 to the driver circuit 200. If a second matrix of data 402 is saved into the data buffer 430 (to erase the first matrix of data 401), the second matrix of data 402 then is outputted via the interface connector 300 to the driver circuit 200. The third matrix of data 403 is lastly saved into the data buffer and also is lastly outputted via the interface connector 300 to the driver circuit 200. If the first matrix of data 401, the second matrix of data 402, and the third matrix of data 403 are sequentially in a different order saved into the data buffer 430, these three matrices of data will be outputted in that order through the interface connector to the driver circuit 200.

In general, as the display panel 100 is driven by the driver circuit 200, referring to FIG. 1, to use at least three time-divisionally outputted data respectively in the at least three time-divisional periods of the unit-time of displaying one frame of image, a dynamic image shifting is achieved effectively for the image displayed on the display panel. In a specific embodiment, referring to FIG. 1, in each time-divisional period (e.g., one of T0, or T1, or T2), the driver circuit 200 is configured to generate a control signal to scan one row of the display panel 100 to load one row of the respective matrix of data (e.g., one of matrix of data 401, or 402, or 403) from the data buffer to a respective row of subpixels in a same timing order of these data being saved to the data buffer. This is performed continuously with the same tinting order from a first row to a last row. As the scan signal scans through all scan lines 221 one row after another, the display panel 100 displays a frame of image based on the time-divisional data in the unit-time for displaying one frame of image. Again, the display panel continuously performs the same display scheme using the time-divisional data with the same timing order for display image one frame after another. This display scheme substantially enhances display resolution in human's visual impression. It also helps making up the physical gaps (e.g., due to black matrix) between subpixels in the display panel.

Referring to FIG. 3, in an embodiment, the interface connector 300 further is configured to halt outputting in a gap time T between each two sequential timing signals. After the first matrix of data 401 is outputted in period T0 enabled by timing signal MIPI(T0), the output is stopped temporarily within the gap time T. Then, another timing signal MIPI(T1) is provided with its rising edge being delayed by the gap time T from the falling edge of last timing signal MIPI(T0). The gap time T is introduced to provide an off period for the liquid crystal layer in the display panel (assuming that the display panel is an LCD display panel) to eliminate aliasing and smear effect of image displayed using two matrices of data respectively in two sequential time-divisional periods. The value of the gap time T can be selected based on a pixel response time Tr of a specific liquid crystal layer used in the display panel 100. The pixel response refers to liquid crystal molecule rotation in response to a change of electric field caused by respective subpixel circuits associated with a liquid crystal layer in the display panel 100 based on change of two subsequent matrices of data received by the driver circuit 200 via the interface connector 300 from the data buffer 430. Either one of the time-divisional period T0, T1, or T2 must be no smaller than Tr. A sum of period T0, period T1, period T2, and at least two gap times 2T is no greater than the unit-time of displaying one frame of image. For example, a pixel response time of liquid crystal molecule is Tr=4 ms. Then, minimum time period for T0, T1, or T2 is 4 ms. If a unit-time of displaying one frame of image is divided to three time-divisional periods, total displaying time (based all three sets of data) is at least 12 ms. If the refreshing rate of the display panel is 60 Hz, the unit-time of displaying one frame of image is 16.6 ms. At least two gap times for the three time-divisional periods are needed, so the gap time T will be set to no greater than 2.3 ms. For a LCD display panel having a liquid crystal layer with faster pixel response time (i.e., with a smaller Tr), the minimum time period for displaying image based on each time-divisionally outputted data can be smaller, making it possible for application providing higher refreshing rate.

In another embodiment, for display panel 100 based on organic light-emitting diode (OLED) subpixels or other panel using active light-emitting subpixels, the pixel response time of OLED is substantially negligible. Therefore, the time-divisional periods can be selected to be substantially free of lower bound, making the time-divisionally outputted data very suitable for displaying high quality, very smooth, and dynamic image on high refreshing rate (such as 240 Hz or higher) display apparatus.

In another aspect, the present disclosure provides a display apparatus including the display-driving circuit described herein coupled to a display panel substantially as shown in FIG. 1. The display panel is configured to display each frame of image using time-divisional data delivered from the display-driving circuit. For example, the time-divisional data is provided as a first matrix of data in a first period T0, a second matrix of data in a second period T1, and a third matrix of data in a third period T2, where T0, T1, and T2 are time-divisional periods of a unit-time for displaying one frame of image. In an embodiment, a timing order of displaying image on the display panel using the first, or, second, or third matrix of data respective in T0, T1, or T2 is kept the same as a sequential timing order of the display-driving circuit generating and saving them into a data buffer.

Figure 4:
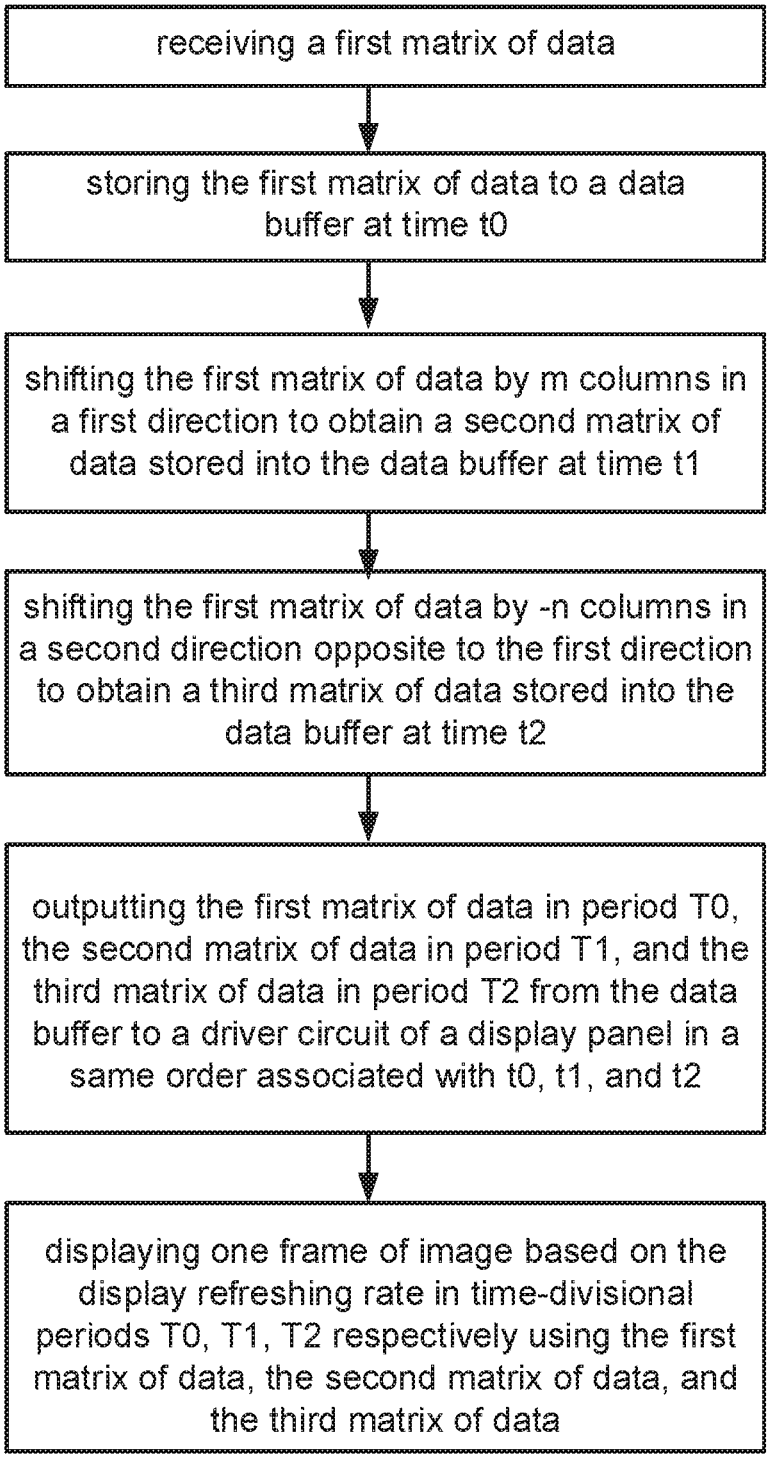
FIG. 4 is a flow chart illustrating a method for displaying one frame of image using time-divisional image data according to the embodiment of the present disclosure.

In another aspect, the present disclosure provides a method for displaying one frame of image using time-divisional image data. FIG. 4 shows a flow chart illustrating a method for displaying one frame of image using time-divisional image data sequentially outputted to a display apparatus according to the embodiment of the present disclosure. Referring to FIG. 4, the method includes a step of receiving a first matrix of data from a system driver of the display apparatus into a data processor or a pre-processor ahead of regular driver integrated circuit (driver IC). The data processor includes at least a data buffer, a first shift register, and a second shift register.

Optionally, referring to FIG. 4, the method further includes a step of storing the first matrix of data to the data buffer at time t0. Optionally, the method also includes shifting the first matrix of data by m columns in a first direction to obtain a second matrix of data stored into the data buffer at time t1 that is different from t0. Optionally, the method also includes shifting the first matrix of data by −n columns in a second direction opposite to the first direction to obtain a third matrix of data stored into the data butler at time t2. The time t2 is different from either t0 or t1 yet being fixed in a fixed sequential timing order associated with t0, t1, and t2. Optionally, t0 is ahead of t1, t2 in time. Optionally, t1 is ahead of t0, t2 in time. Optionally, t2 is ahead of t1, t0 in time. Yet, the data buffer is configured to save temporarily just one set of data either the first matrix of data, or the second matrix of data, or the third matrix of data in the fixed sequential timing order.

Optionally, the method includes a step of outputting the first matrix of data in period T0, the second matrix of data in period T1, and the third matrix of data in period T2 from the data buffer to a driver circuit of a display panel in an order same as the fixed sequential timing order associated with t0, t1, and t2. The period T0, the period T1, and the period T2 are at least three time-divisional periods of one unit-time for displaying one frame of image which is depended on a display refreshing rate designed for the display apparatus. In an embodiment, the method further includes displaying one frame of image based on display refreshing rate using the first matrix of data in the period T0, the second matrix of data in the period T1, and the third matrix of data in the period T2, in the embodiment, the driver IC receives each set of data, either the first matrix of data, the second matrix of data, or the third matrix of data, and generate control signals to scan through all rows of subpixel circuits in a display panel to load a respective matrix of data within a respective one of the at least three time-divisional periods T0, T1, and T2.

In the embodiment, the step of shifting the first matrix of data by m columns in a first direction includes allowing the first matrix of data to be processed by a shift register configured to assigning respective k-th column of data in the first matrix of data to (k−m)-th column of data of the second matrix of data and keeping all of the last m numbers of columns of data repeated as the last column of data in the first matrix of data. Particularly, in is an integer less than 10. In an example, m=1, each column in the first matrix of data is shifted by one column forward to obtain the second matrix of data. The second matrix of data and the first matrix of data can be delivered from the driver IC to the display panel in time-divisional manner so that the display panel can display a dynamically yet smoothly shifted image data with enhanced visual resolution.

In the embodiment, the step of shifting the first matrix of data by −n columns in a second direction includes allowing the first matrix of data to be processed by a shift register configured to assigning respective k-th column of data in the first matrix of data to (k+n)-th column of data of the third matrix of data and keeping all of the first n numbers of columns of data repeated as the first column of data in the first matrix of data. Particularly, n is an integer less than 10. In an example, n=1, each column of the first matrix of data is shifted by one column backward to obtain the third matrix of data. The third matrix of data, the second matrix of data, and the first matrix of data can be delivered from the driver IC to the display panel in time-divisional manner so that the display panel can display a dynamically yet smoothly shifted image data with enhanced visual resolution.

In the embodiment, the method includes setting either one of period T0, T1, and T2 to be no smaller than a pixel response time associated with the display panel.

In the embodiment, the step of outputting further includes halting outputting in a gap time T between any two sequential timing signals. The gap time is determined based on sum of the at least T0, T1, T2, and two gap times 2×T is no greater than a unit-time of displaying one frame of image depended on the display refreshing rate. For LCD display, each time-divisional period is set to be at least the minimum pixel response time associated with the liquid crystal layer of the display panel. For OLED display, since each subpixel circuit include an active light-emitting device of which the pixel response time is substantially negligible so that there is no theoretical lower bound to be set for the time-divisional period and the display method can be implemented in display apparatus with super high refreshing rate.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive, Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a. limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A display-driving circuit based on time-divisional data output comprising:

a data processor including at least a first shift register and a data buffer, and configured to receive a first frame of image data based on display refreshing rate and store a first matrix of data corresponding to the first frame of image data to the data buffer at time t0, to cause a m-column shift to the first matrix of data by the first shift register to obtain a second matrix of data stored to the data buffer at time t1, where t1 is different from t0 with a fixed sequential timing order of either t0 is earlier than t1 or vice versa;

an interface connector configured to control outputting of the first matrix of data and the second matrix of data based on timing signals provided in an order same as the fixed sequential timing order respectively over at least two time-divisional periods T0 and T1 of a unit-time for displaying one frame of image; and a driver circuit coupled to the interface connector to apply a respective column of a respective one of the first matrix of data and the second matrix of data to a respective one of multiple data lines;

wherein a sum of the at least two time-divisional periods T0 and T1 is smaller than or equal to the unit-time for displaying one frame of image which is inverse of the display refreshing rate.

2. The display-driving circuit of claim 1, wherein the interface connector is configured to halt outputting in a gap time T between each two sequential timing signals, wherein a sum of the at least two time-divisional periods T0 and T1, and the gap time T between the at least two time-divisional periods T0 and T1 is no greater than the unit-time for displaying one frame of image.

3. The display-driving circuit of claim 1, wherein the m-column shift corresponds to that a k-th column of data in the second matrix of data is set to equal to (k−m)-th column of data in the first matrix of data and each of first m numbers of columns of data of the second matrix of data is repeated as a first column of data of the first matrix of data, wherein m is an integer smaller than 10.

4. A display apparatus comprising a display-driving circuit of claim 1 and a display panel comprising an array of pixel circuits with a respective one column being connected to a respective one data line coupled to a driver integrated circuit to receive a first matrix of data and a second matrix of data in respective time-divisional periods T0 and T1 of a unit-time for displaying one frame of image to display a frame of image.

5. The display apparatus of claim 4, wherein the display panel comprises a liquid crystal layer configured to yield a respective transmissivity for a respective one of a plurality of subpixels within a minimum liquid-crystal response time Tr based on data of a respective one subpixel from the first matrix of data in period T0 and the second matrix of data in period T1, wherein the period T0 or period T1 is no smaller than Tr.

6. The display apparatus of claim 4, wherein the display panel comprises a light-emitting diode layer configured to emit light at a respective one of a plurality of subpixels within a pixel-response time Tpr to yield a pixel luminance based on data of a respective one subpixel from the first matrix of data in period T0 and the second matrix of data in period T1, wherein the pixel-response time Tpr is substantially negligible and the at least two time-divisional periods T0 and T1 are substantially free of a low bound.

7. A display-driving circuit based on time-divisional data output comprising:

a data processor including at least a first shift register and a data buffer, and configured to receive a first frame of image data based on display refreshing rate and store a first matrix of data corresponding to the first frame of image data to the data buffer at time t0, to cause a m-column shift to the first matrix of data by the first shift register to obtain a second matrix of data stored to the data buffer at time t1, where t1 is different from t0 with a fixed sequential timing order of either t0 is earlier than t1 or vice versa;

an interface connector configured to control outputting of the first matrix of data and the second matrix of data based on timing signals provided in an order same as the fixed sequential timing order respectively over at least two time-divisional periods T0 and T1 of a unit-time for displaying one frame of image; and a driver circuit coupled to the interface connector to apply a respective column of a respective one of the first matrix of data and the second matrix of data to a respective one of multiple data lines;

wherein the data processor further comprises a second shift register configured to receive the first frame of image data and cause a −n-column shift to the first matrix of data to obtain a third matrix of data stored to the data buffer at time t2, wherein t2 is different from t0 or t1 and t0, t1, and t2 are in a fixed sequential timing order.

8. The display-driving circuit of claim 7, wherein −n-column shift corresponds to that a k-th column of data in the third matrix of data is set to equal to (k+n)-th column of data in the first matrix of data and each of last n numbers of columns of data of the third matrix of data is repeated as a last column of data in the first matrix of data, wherein n is an integer smaller than 10.

9. The display-driving circuit of claim 7, wherein the interface connector is configured to control outputting of the first matrix of data, the second matrix of data, and the third matrix of data based on timing signals provided in an order same as the fixed sequential timing order associated with t0, t1, and t2 respectively over at least three time-divisional periods T0, T1, and T2 of a unit-time for displaying one frame of image.

10. The display-driving circuit of claim 9, wherein the interface connector is configured to halt outputting in a gap time T between any two sequential timing signals, wherein a sum of the at least three time-divisional periods T0, T1, T2, and at least two gap times 2T between two sequential pairs of periods is no greater than the unit-time for displaying one frame of image, and either one of T0, T1, and T2 is no smaller than a response time associated with subpixels of a display panel.

11. A method for displaying one frame of image using time-divisional image data comprising:

receiving a first matrix of data from a system driver;

storing the first matrix of data to a data buffer at time t0;

shifting the first matrix of data by m columns in a first direction to obtain a second matrix of data stored into the data buffer at time t1, t1 being different from t0;

shifting the first matrix of data by −n columns in a second direction opposite to the first direction to obtain a third matrix of data stored into the data buffer at time t2, t2 being different from either t0 or t1 yet being fixed in a fixed sequential timing order associated with t0, t1, and t2;

outputting the first matrix of data in period T0, the second matrix of data in period T1, and the third matrix of data in period T2 from the data buffer to a driver circuit of a display panel in an order same as the fixed sequential timing order associated with t0, t1, and t2, wherein the period T0, the period T1, and the period T2 are at least three time-divisional periods of one unit-time for displaying one frame of image depending on display refreshing rate; and displaying one frame of image based on display refreshing rate using the first matrix of data in the period T0, the second matrix of data in the period T1, and the third matrix of data in the period T2.

12. The method of claim 11, wherein the shifting the first matrix of data by m columns in a first direction comprises allowing the first matrix of data to be processed by a shift register configured to assigning respective k-th column of data in the first matrix of data to (k−m)-th column of data of the second matrix of data and keeping all of last m numbers of columns of data repeated as a last column of data in the first matrix of data, wherein m is an integer less than 10.

13. The method of claim 11, wherein the shifting the first matrix of data by −n columns in a second direction comprises allowing the first matrix of data to be processed by a shift register configured to assigning respective k-th column of data in the first matrix of data to (k+n)-th column of data of the third matrix of data and keeping all of first n numbers of columns of data repeated as a first column of data in the first matrix of data, wherein n is an integer less than 10.

14. The method of claim 11, wherein the outputting comprises providing at least three sequential timing signals in a same fixed sequential timing order to respectively enable an interface connector coupled between the data buffer and the driver circuit over three time periods respectively equal to period T0, period T1, and period T2.

15. The method of claim 14, wherein either one of period T0, T1, and T2 is set to be no smaller than a pixel response time associated with the display panel.

16. The method of claim 15, wherein the outputting further comprises halting outputting in a gap time T between any two sequential timing signals, wherein the gap time T is determined by that a sum of the at least T0, T1, T2, and two gap times 2×T is no greater than a unit-time of displaying one frame of image depended on the display refreshing rate.

17. The method of claim 15, wherein the display panel is a liquid crystal display panel comprising a liquid crystal layer over a plurality of subpixels, the displaying comprises setting a respective one of period T0, period T1, and period T2 to be no smaller than a response time of the liquid crystal layer to a respective one matrix of data applied to the plurality of subpixels.

18. The method of claim 15, wherein the display panel is a light-emitting diode display panel comprising a plurality of subpixels, the displaying comprises setting a respective one of period T0, period T1, and period T2 to be substantially free of low bound as a response time for the plurality of subpixels to emit light based on a respective one matrix of data applied thereof.

* * * * *